United States Patent [19]

Craig

[11] Patent Number: 4,533,072

[45] Date of Patent: Aug. 6, 1985

[54] INFLATABLE WADER TREE

[76] Inventor: David R. Craig, 362 Evergreen, Holland, Mich. 49423

[21] Appl. No.: 416,843

[22] Filed: Sep. 13, 1982

[51] Int. Cl.[3] ..... A43D 5/00

[52] U.S. Cl. ..... 223/67; 12/114.4; D2/378.1

[58] Field of Search ..... 12/114.4; 211/34; 223/67, 72, 74, 61, 77; D2/378.1

[56] References Cited

U.S. PATENT DOCUMENTS

| | | | |
|---|---|---|---|
| 222,344 | 12/1879 | Braun . | |
| D. 258,699 | 3/1981 | McPherson . | |
| 258,917 | 6/1882 | Hawley . | |
| 475,679 | 5/1892 | Drake . | |
| 565,544 | 8/1896 | Keane et al. | 223/67 |
| 1,570,508 | 1/1926 | Lungstras | 223/67 |
| 1,680,528 | 8/1928 | LaLonde . | |
| 2,074,140 | 3/1937 | Bates | 223/67 X |
| 2,273,489 | 2/1942 | Holmes | 223/67 |
| 2,538,247 | 1/1951 | Holt | 12/114.4 |
| 2,703,651 | 3/1955 | Brocklehurst | 211/34 |
| 3,483,580 | 12/1969 | Cherry et al. . | |
| 3,729,759 | 5/1973 | Szabo . | |
| 4,400,840 | 8/1983 | Sly | 12/114.4 |

FOREIGN PATENT DOCUMENTS

| | | | |
|---|---|---|---|
| 716713 | 10/1931 | France | 12/114.4 |

*Primary Examiner*—Robert R. Mackey
*Attorney, Agent, or Firm*—John J. Swartz

[57] ABSTRACT

An inflatable wader tree receivable in the upper opening of footwear, such as fishing waders, and shaped, when inflated, to sealingly engage and distend the upper portion of footwear, an air inlet for inflating the tree, and mechanism for distending the lower portion of the footwear, when the tree is inflated, including an outlet in the lower portion of the inflatable tree for passing air from the inflatable tree to the lower footwear portion.

4 Claims, 2 Drawing Figures

INFLATABLE WADER TREE

FIELD OF THE INVENTION

This invention relates to a wader tree and, more particularly, to an inflatable insert for distending waders, and the like, during storage.

BACKGROUND OF THE INVENTION

Waders of the type utilized by fishermen comprise generally pliable material which, when unsupported, will collapse. When stored in a collapsed condition, the waders will wrinkle and deteriorate.

Inflatable boot trees have been provided heretofore, such as that disclosed in U.S. Pat. No. Des. 258,699, issued to Joseph M. McPherson on Mar. 31, 1981; U.S. Pat. No. 1,680,528, issued to J. A. LaLonde on Aug. 14, 1928; U.S. Pat. No. 3,483,580, issued to N. R. Cherry, et al on Dec. 16, 1969; U.S. Pat. No. 475,679, issued to J. E. Drake on May 24, 1982; and U.S. Pat. No. 565,544, issued to H. Keane, et al on Aug. 11, 1896. All of the aforementioned patents include inflatable devices which substantially conform to the entire inner wall of the article being shaped. Waders are relatively large, and the use of such prior art inflatable boot trees requires a relatively large amount of material, which is relatively expensive. Such trees also require substantial storage space when not in use.

Accordingly, it is an object of the present invention to provide a new and novel inflatable tree for distending footwear, such as water impervious waders.

It is yet another object of the present invention to provide an inflatable insert for maintaining the shape of a set of fishing waders during storage.

A still further object of the present invention is to provide an inflatable tree which will utilize substantially less material than the inflatable boot trees known heretofore.

Yet another object of the present invention is to provide an inflatable insert for sealingly engaging and distending the upper portion of the waders but including mechanism for admitting pressurized air to the lower end of the waders to distend the lower portion thereof.

Other objects and advantages of the present invention will become apparent to those of ordinary skill in the art as the description thereof proceeds.

SUMMARY OF THE INVENTION

An inflatable wader insert shaped, when inflated, to sealingly engage and distend the upper portion of the waders, an inlet orifice for admitting air to inflate the insert, and mechanism for distending a lower portion of the waders, comprising an outlet orifice in the lower side of the inflatable insert for passing air from the inflatable insert to the lower portion of the waders.

BRIEF DESCRIPTION OF THE DRAWINGS

These and other objects of the present invention may more readily be understood by reference to the accompanying drawings, in which.

DESCRIPTION OF THE INVENTION

Figure 1:
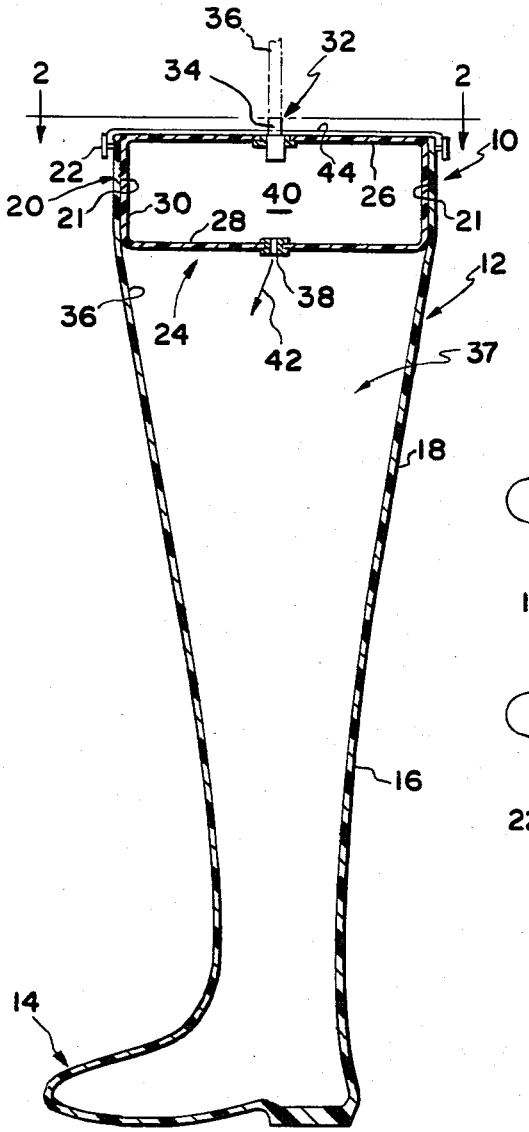
FIG. 1 is a sectional side view illustrating apparatus constructed according to the present invention, in an inflated condition, disposed at the waist of a pair of waders.
Figure 2:
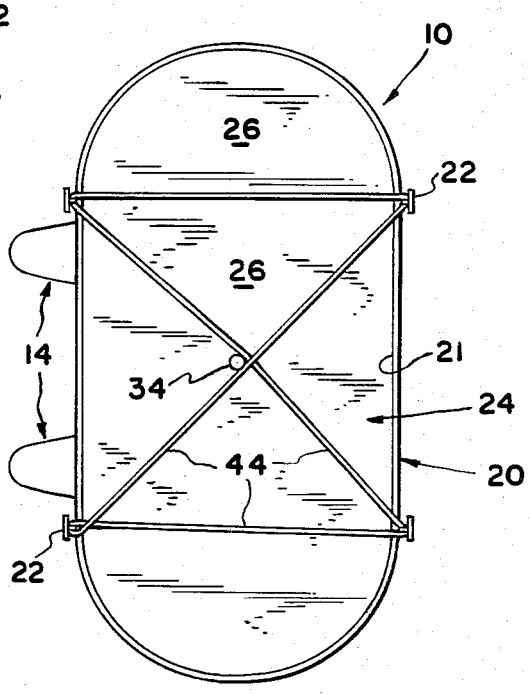
FIG. 2 is a top plan view, taken along the line 2—2 of FIG. 1.

Apparatus constructed according to the present invention, generally designated 10, is particularly adapted for use with a pair of waders, generally designated 12. As usual, the waders 12 include a pair of foot-receiving portions 14 integrally connected to a pair of lower leg-receiving portions 16, upper leg-receiving portions 18, and an enlarged diameter waist portion 20 defining a waist-receiving opening 21. The waders 12 are typically manufactured from pliable water and air impervious material such as rubber or plastic and, thus, the waist portion 20 is provided with suspender-mounting buttons 22 so that the waders can be supported by the shoulders of the user.

The apparatus 10 constructed according to the present invention comprises an inflatable bag insert or tree, generally designated 24, including a top wall 26, a bottom wall 28, and a side wall 30 integral with the top and bottom walls 26 and 28.

An air inlet or orifice, generally designated 32, is provided in the top wall 26 and is coupled to a source of pressurized air, generally designated 36. An openable and closeable valve 34, which may suitably comprise a plug which is selectively inserted into the orifice 32, is provided for closing orifice 32 when the tree 10 is inflated.

It should be noted that the bottom wall 28 of the inflatable insert 24 is disposed in vertically-spaced relation with the leg portions 16 and 18 and the bottom or shoe portions 14 of the waders 12. When expanded or inflated, the tree side wall 30 sealingly engages the inside wader wall or surface 36 of the waist portion 20 to form a sealed chamber 37 within the waders below the inflatable insert 24. In the expanded condition illustrated in the drawings, the insert will expand or distend the waist portion 20 of waders 12.

The bottom wall 28 of inflatable tree 24 includes an air outlet or orifice 38 which permits air, admitted to the chamber 40 of the insert 24 to pass downwardly therethrough, in the direction represented by the arrows 42, to the lower, internal, sealed wader chamber 37. The lower orifice or outlet 38 is of substantially smaller size than the orifice or inlet 34 such that, even though the tree side wall 30 does not seal to the wader wall or surface 36, the volume and/or rate of flow of air through the outlet 38 is substantially less than the flow or volume of air passing through inlet 34. Accordingly, the insert 24 can inflate even though the orifice 38 always remains open.

To preclude the insert 24, when inflated, from inadvertently passing upwardly through the waist-receiving opening 21, at the upper end of the waders 12, the apparatus 10 includes a pair of transversely-disposed retaining straps 44 overlying the inflatable insert 24 and are coupled to the suspender buttons 22.

THE OPERATION

The inflatable tree insert 24 is inserted into the upper waist-receiving opening 21 in a collapsed and/or partially-inflated condition. Pressurized air is admitted through the inlet orifice or valve opening 32 to inflate the insert 24 to distend the wader portion 20. Even though air is permitted to flow outwardly through outlet 38 while air is being initially admitted through inlet 34, the tree 24 will inflate.

When the tree is inflated, the tree side wall 30 sealingly engages the wader side wall portion 36 to form a lower internal sealed wader chamber 37. Thereafter, the air passing through the lower orifice 38, represented by arrows 42, will be trapped in the lower chamber portion of the waders. As air continues to pass to the chamber 37, the air pressure therein will build to distend the leg portions 18 and remove any wrinkles therefrom. When the air pressure in the chamber 37 equals the pressure in the inflatable insert 24, the flow of air through orifice 32 to the insert 24 will cease. At that time, the valve 34 can be operated to decouple the orifice 32 from the source of pressurized air 36. The waders can then be stored, wrinkle-free.

It is to be understood that the drawings and descriptive matters are in all cases to be interpreted as merely illustrative of the principles of the invention, rather than as limiting the same in any way, since it is contemplated that various changes may be made in various elements to achieve like results without departing from the spirit of the invention or the scope of the appended claims.

What I claim is:

1. An inflatable tree for maintaining the shape of stored footwear, such as waders and the like, having a foot-receiving portion and an upstanding leg-receiving portion provided with an upper portion having an upwardly-opening, upper opening therein, said inflatable tree comprising:

inflatable and deflatable insert means, detachably receivable in the upper opening of said footwear, having a side wall and integral top and bottom walls;

said insert means, when inflated, being of such size and shape that said side wall is in sealing engagement with and detachably secured to said upper portion of said footwear and said bottom wall is vertically spaced from said foot receiving portion to form a sealed chamber within the footwear below the tree;

said insert means, when deflated, being of such size and shape that said side wall is not in sealing engagement with said upper portion to allow said insert means to be detached from said footwear;

openable and closeable air inlet means, at the upper end of said tree, for admitting air into said tree to inflate and expand said tree so that said side wall sealingly engages and is detachably secured to said upper portion of said footwear; and air outlet means, in said bottom wall of said tree, for permitting air within said tree to escape outwardly therethrough to said sealed chamber to distend the lower portion of said footwear;

said air outlet means being of such construction as to permit substantially less air to pass outwardly therethrough than said air inlet means admits to said tree to allow said tree to inflate; and means for overlying said tree to preclude the upward movement of said tree through said upper opening.

2. The tree set forth in claim 1 including means for selectively attaching said means for overlying said tree to the upper end portion of said footwear adjacent said upper opening.

3. Apparatus for distending footwear, such as waders and the like, comprising air and water impervious material, having a lower foot-receiving portion and an integral upper leg-receiving portion provided with an upper portion having an upwardly-opening upper opening, comprising:

inflatable and deflatable means detachably receivable in said upper opening;

said inflatable and deflatable means shaped, when inflated to an inflated condition, to sealingly engage and be detachably secured to said upper portion of said footwear to distend said upper portion while being in vertically spaced relation with said foot receiving portion to form a sealed chamber within said footwear below said inflatable means;

said inflatable and deflatable means shaped, when deflated to a deflated condition, to not sealingly engage said upper portion of said footwear to allow said inflatable and deflatable means to be detached from said footwear;

openable and closeable inlet orifice means, in the upper portion of said inflatable means, for admitting air, under pressure, to inflate said inflatable means from said deflated condition to said inflated condition;

means for distending a lower portion of said boot, comprising:

outlet orifice means in the lower side of said inflatable means for passing air from said inflatable means to said lower portion of said footwear and said chamber to distend said lower portion of said footwear; and means for detachably securing said inflatable and deflatable means to said footwear.

4. In combination, footwear such as waders, comprised of air and water impervious material, having a pair of lower foot-receiving portions, a pair of upstanding expansible and collapsible leg-receiving portions integral with said foot-receiving portions, and a pliable, expansible and collapsible waist portion integral with said leg portions and defining an upper, upwardly-opening waist-receiving opening;

apparatus for maintaining the shape of said footwear comprising:

inflatable and deflatable insert means, detachably received by said waist portion, having upper and lower walls spanned by a side wall integral therewith;

openable and closeable air inlet means in said upper wall for passing air to the inside of said insert means from a deflated condition not in sealing engagement with and detached from said waist portion of said footwear to an inflated condition in which said side wall sealingly engages and is detachably secured to said waist portion of said footwear to define a sealed chamber within said footwear below said insert;

said lower wall being disposed at a level in spaced relation with said leg and foot-receiving portions of said waders; and air outlet means in said lower wall for passing air to said leg and foot portions to distend said leg portions;

said air outlet means constricting the outward flow of air relative to the inward flow of air by said inlet means to allow said insert means to inflate; and means coupled to said footwear and overlying said insert means for preventing upward movement of said insert means relative to said footwear.

* * * * *